US012312914B2

(12) United States Patent
Morrison et al.

(10) Patent No.: US 12,312,914 B2
(45) Date of Patent: May 27, 2025

(54) BULKHEAD IGNITER WITH SNAP-ON INSULATOR

(71) Applicant: DBK Industries, LLC, Crowley, TX (US)

(72) Inventors: Jeremy Todd Morrison, Pickton, TX (US); Tyler Lee Smith, North Richland Hills, TX (US)

(73) Assignee: DBK INDUSTRIES, LLC, Crowley, TX (US)

( * ) Notice: Subject to any disclaimer, the term of this patent is extended or adjusted under 35 U.S.C. 154(b) by 0 days.

(21) Appl. No.: 18/391,638

(22) Filed: Dec. 20, 2023

(65) Prior Publication Data

US 2024/0209715 A1 Jun. 27, 2024

Related U.S. Application Data

(60) Provisional application No. 63/435,305, filed on Dec. 26, 2022.

(51) Int. Cl.
*E21B 33/14* (2006.01)
*E21B 7/00* (2006.01)
*E21B 36/00* (2006.01)

(52) U.S. Cl.
CPC ..... *E21B 36/003* (2013.01); *E21B 7/007* (2013.01); *E21B 33/14* (2013.01); *E21B 2200/01* (2020.05)

(58) Field of Classification Search
CPC ..... E21B 33/14; E21B 36/003; E21B 36/00
USPC ..... 166/302
See application file for complete search history.

(56) References Cited

U.S. PATENT DOCUMENTS 5,055,030 A * 10/1991 Schirmer ..... F22B 1/26 431/185
2017/0130531 A1* 5/2017 Russell ..... F42B 12/06
2021/0198983 A1* 7/2021 Eitschberger ..... E21B 43/117
2021/0404283 A1* 12/2021 Carragher ..... E21B 17/042

* cited by examiner

*Primary Examiner* — Zakiya W Bates
*Assistant Examiner* — Ashish K Varma
(74) *Attorney, Agent, or Firm* — Johnston IP Law, PLLC

(57) ABSTRACT

In the context of downhole tools, bulkhead igniter assemblies having snap-on insulators are disclosed. In some embodiments the bulkhead igniter assemblies have a bulkhead with a first end formed with at least one ridge or groove, a pressure block, a setting tool, and a snap-on insulator. The snap-on insulator has an annular body having a tubular channel through a center portion. Ridges or groves on the snap-on insulator mate with ridges or grooves on the bulkhead igniter to hold the snap-on insulator in place on the bulkhead igniter by interaction of the ridge or groove of the snap-on insulator with the ridge or groove on the first end of the bulkhead igniter. Other embodiments are disclosed.

18 Claims, 10 Drawing Sheets

BULKHEAD IGNITER WITH SNAP-ON INSULATOR

CROSS-REFERENCE TO RELATED APPLICATION

This application claims the benefit of U.S. Provisional Application Ser. No. 63/435,305, filed on Dec. 26, 2022, entitled "Bulkhead Igniter with Snap-On Insulation," which is incorporated herein by reference in its entirety for all purposes.

TECHNICAL FIELD

This application is directed, in general, to the recovery of hydrocarbons, and more particularly to bulkhead igniters with snap-on insulators.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Oil and gas wells are drilled into earth formations by first creating a borehole and then running and cementing casing in the borehole. Well tools such as bridge plugs, packers, cement retainers, and frac plugs are often run into cased wells and set using setting tools powered by flammable power charges. At times, an electrical signal or communications are sent downhole through various components. While practices and equipment have been developed to enable such signals or communications, improvements are desired.

SUMMARY

According to an illustrative embodiment, a bulkhead igniter assembly includes a bulkhead igniter having a first end and a second end, a pressure block having a first end and a second end, a setting tool having a first end and a second end, a downhole component having a first end and a second end, and a snap-on insulator. The first end of the bulkhead igniter is formed with at least one ridge or groove and is disposed within a cavity of the pressure block. The pressure block is at least partially disposed within a cavity of the setting tool located proximate to the first end of the setting tool. The second end of the downhole component is attached to the first end of the setting tool or to the first end of the pressure block and the second end of the downhole component is disposed proximate to the first end of the bulkhead igniter. The snap-on insulator includes an annular body having a tubular channel through a center portion. The snap-on insulator has a first end and a second end and an interior of the tubular channel is formed with a ridge or a groove that is sized and configured to be a complimentary member to the ridge or groove on the first end of the bulkhead igniter, whereby the snap-on insulator is held in place on the bulkhead igniter by interaction of the ridge or groove of the snap-on insulator with the ridge or groove on the first end of the bulkhead igniter. The snap-on insulator is formed from a material that allows for enough flexibility for a ridge-and-groove coupling to occur so that the snap-on insulator may be installed onto the bulkhead igniter by pressing the snap-on insulator onto the bulkhead igniter to engage the ridge or groove of the snap-on insulator with the ridge or groove of the first end of the bulkhead igniter, and the snap-on insulator is formed from a material that will not conduct electricity.

According to an illustrative embodiment, a bulkhead igniter assembly includes a bulkhead igniter having a first end and a second end, a pressure block having a first end and a second end, and a snap-on insulator. The first end of the bulkhead igniter is formed with at least one ridge or groove. The bulkhead igniter is disposed within a cavity of the pressure block. The snap-on insulator is attached to the first end of the bulkhead igniter, and includes an annular body having a tubular channel through a center portion. The snap-on insulator has a first end and a second, and an interior of the tubular channel is formed with a ridge or a groove that is sized and configured to be a complimentary member to the ridge or groove on the first end of the bulkhead igniter. The snap-on insulator is held in place on the bulkhead igniter by interaction of the ridge or groove of the snap-on insulator with the ridge or groove on the first end of the bulkhead igniter, and the snap-on insulator is formed from a material that allows for enough flexibility for a ridge-and-groove coupling to occur so that the snap-on insulator may be installed onto the bulkhead igniter by pressing the snap-on insulator onto the bulkhead igniter to engage the ridge or groove of the snap-on insulator with the ridge or groove on the first end of the bulkhead igniter. The snap-on insulator is formed from a material that will not conduct electricity.

According to an illustrative embodiment, a bulkhead igniter assembly includes a pressure bulkhead having a first end and a second end; an annular protrusion formed on the first end of the pressure bulkhead; a pressure block sized and configured to couple to an interior of a setting tool; and a snap-on insulator sized and configured to couple to the annular protrusion with a snap-on connection. The pressure block is sized and configured to receive and hold the pressure bulkhead. The annular protrusion of the pressure bulkhead is formed with a pin cavity. Other devices, systems, and methods are disclosed herein.

DESCRIPTION OF THE DRAWINGS

Illustrative embodiments of the present invention are described in detail below with reference to the attached drawing FIGURES, which are incorporated by reference herein and wherein.

DETAILED DESCRIPTION

Figure 1:
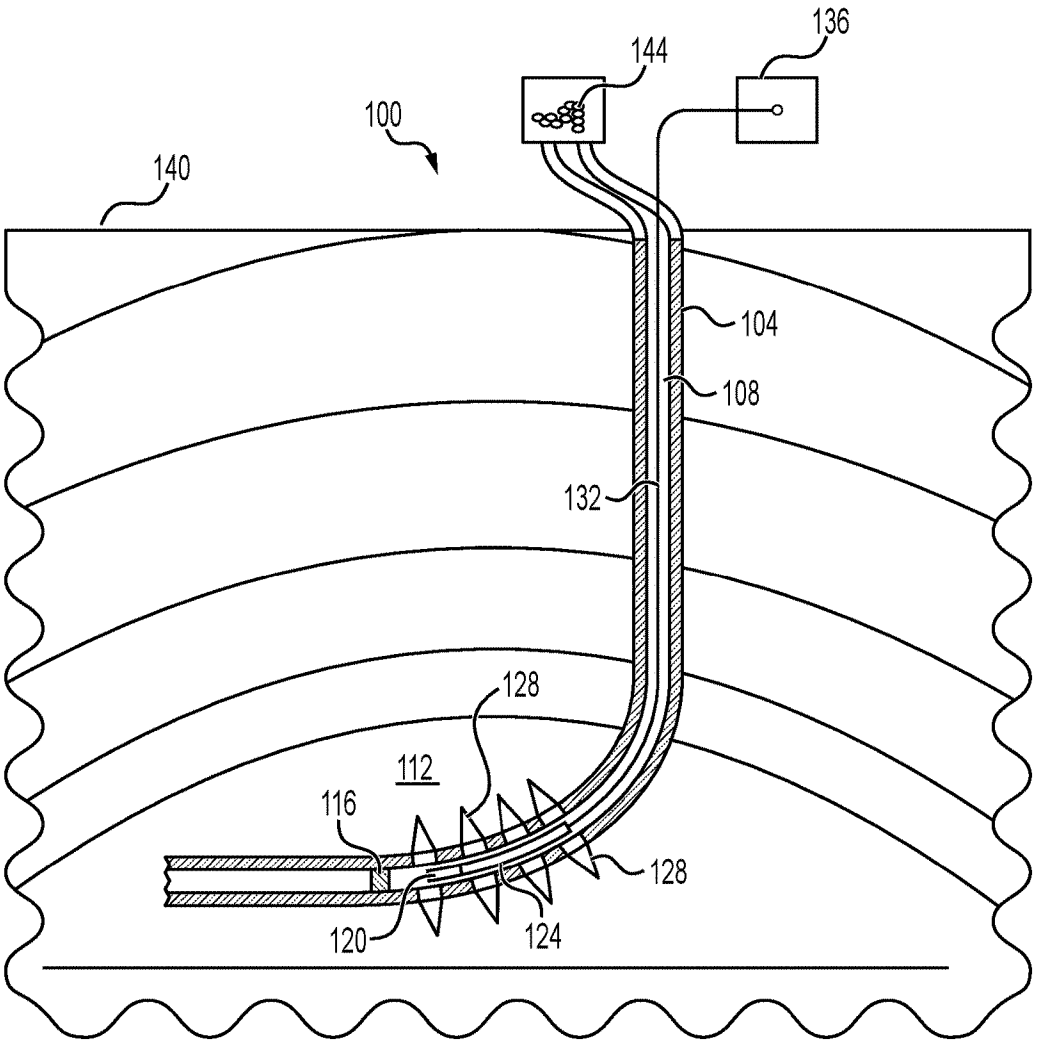
FIG. 1 is schematic, diagram of a well undergoing an aspect of well completion according to an illustrative embodiment.

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Unless otherwise indicated, as used throughout this document, "or" does not require mutual exclusivity. As used herein, "a" refers to at least one.

In efforts to recover hydrocarbons from the ground, wells 100 are drilled to the desired depth and then must be completed to make the well ready for production. An aspect of this involves applying casing 104 to protect the wellbore 108. The casing 104 is cemented in place and then steps are taken to connect to the desired subterranean formation 112 to extract the hydrocarbons. This may involve plugging the well 100 with a plug 116 delivered by a setting tool 120 and then perforating the casing 104 with a perforating gun assembly 124. The perforation process produces channels 128. In this illustration, the setting tool 120 has disconnected from the plug 116.

Figure 2:
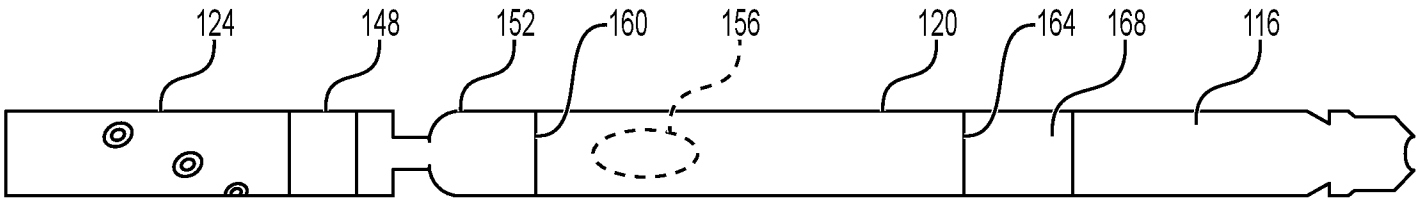
FIG. 2 is a schematic, diagram of a perforating gun assembly and setting tool according to an illustrative embodiment.

Reference is made initially to FIGS. 1 and 2. The setting tool 120 is powered in this instance by gases generated in situ. A power charge is initiated that creates the high-pressure gases that are used to move parts relative to one another and cause the setting tool 120 to perform the desired work, such as setting plug 116 in position in the wellbore. Flames from an igniter ignite the power charge located in a combustion chamber in the setting tool which causes one or more pistons to move, and that movement actuates one part of the plug or other aspects of the setting tool 120.

A wireline 132 may be used to control the perforation gun assembly 124 and the setting tool 120. The wire line 132 may be electrically coupled to a control interface 136 at the surface 140 and allow an operator to control the sending of electrical signals to the perforating gun assembly 124 or the setting tool 120. In the case of activation of a bulkhead igniter 156 (FIGS. 2 and 3), an electrical current is sent through wire line 132 and possibly various downhole components that, on a downhole string, are uphole relative to the bulkhead igniter 156. The electrical current activates an explosive or flammable charge within the bulkhead igniter 156, which in turn activates an explosive charge within the setting tool 120 to provide gases to activate components.

Also shown symbolically, a fluid 144 (FIG. 1), such as water and sand or fracturing fluid, may be pumped down the well for moving the perforating gun assembly 124 and the setting tool 120 to a desired depth to perform the referenced operations or other purposes. The operations may be repeated as many times as necessary to prepare the well to produce hydrocarbons.

Figure 3:
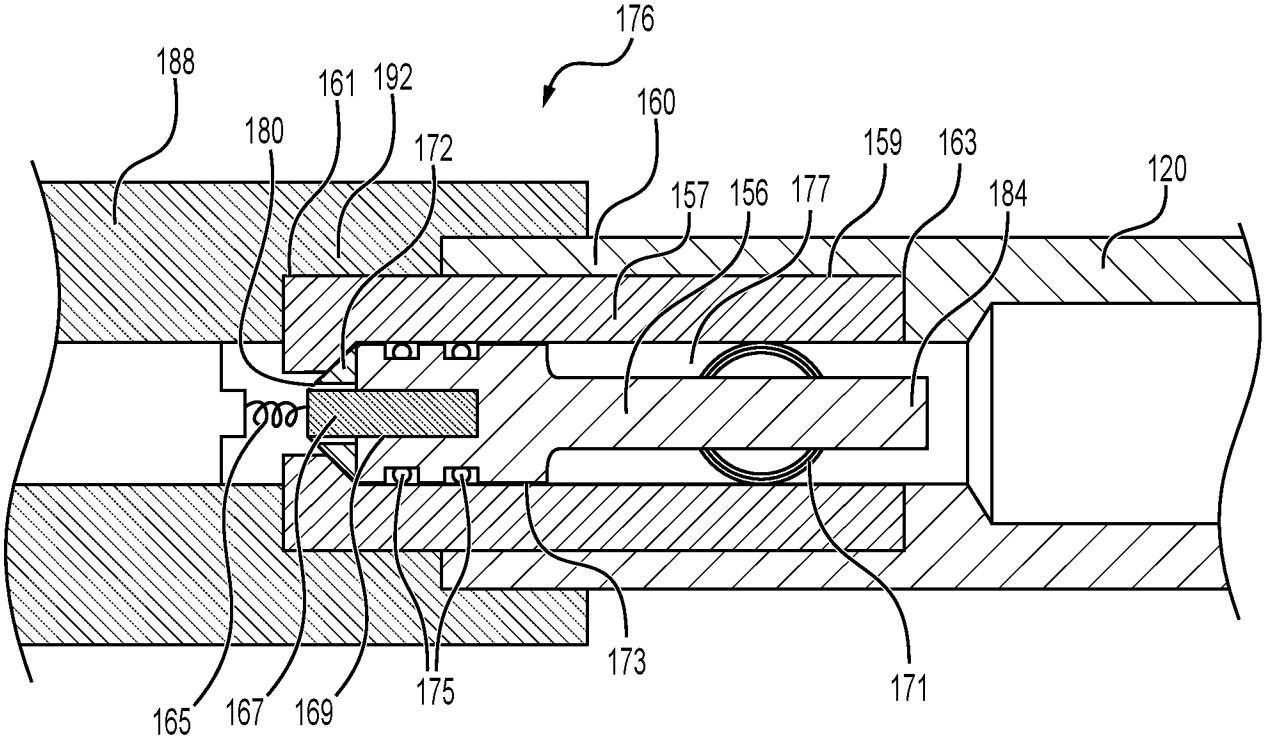
FIG. 3 is a schematic, cross section of a portion of a setting tool showing a portion of a bulkhead igniter assembly according to an illustrative embodiment.
Figure 4:
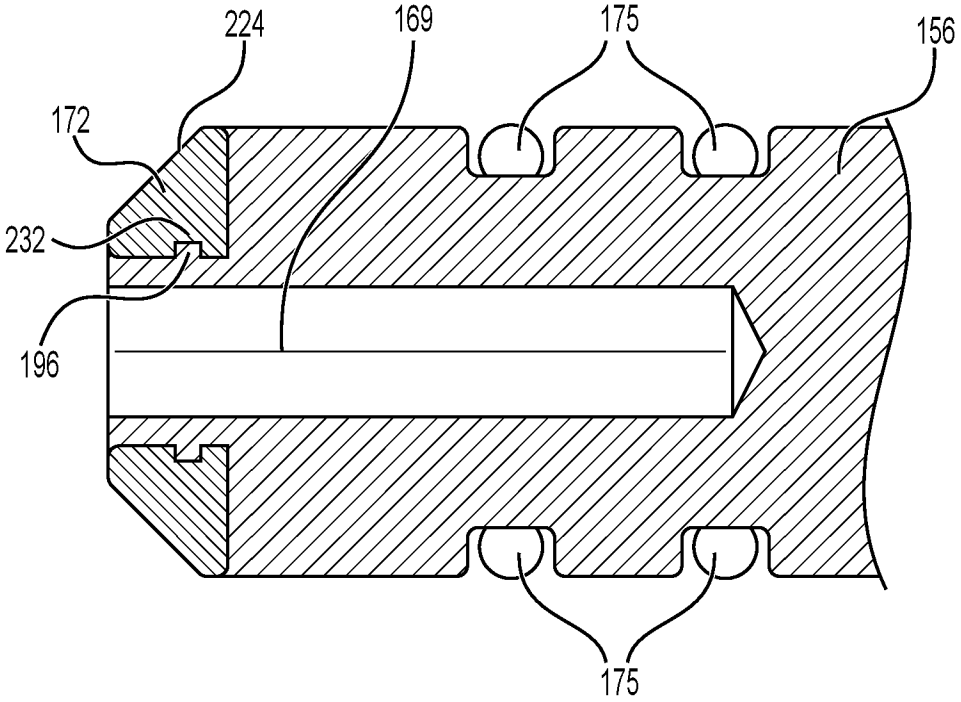
FIG. 4 is a schematic, cross-sectional view of a portion of a bulkhead igniter according to an illustrative embodiment.

In providing an electrical signal from the wire line 132 through the perforating gun assembly 124 and aspects of the setting tool 120, electrical connections should be maintained. In this regard, some components may be anodized. If the anodization is compromised, the setting tool 120, for example, electrical circuits therein may be compromised and may not be properly controlled. One place where an issue has been observed is on a first end (uphole) of a pressure bulkhead igniter (see e.g. 156 in FIG. 3). As described further below, an aspect of the disclosure is to provide a snap-on insulator 172 (FIGS. 3-10) to protect the bulkhead igniter 156 at that end and to prevent an electrical short circuit between the bulkhead igniter 156 and other components that are in contact with the bulkhead igniter 156, such as the pressure block 157 (FIG. 3). As used herein, a bulkhead igniter ((see e.g. 156 in FIG. 3) means an igniter used in a downhole tool, such as a setting tool, that maintains or promotes a pressure differential between the uphole side of the igniter and the downhole side of the igniter to at least a certain pressure level.

Referring now primarily to FIG. 2, an illustrative embodiment of the perforating gun assembly 124 and setting tool 120 is presented. Those skilled in the art will appreciate that many different arrangements may be used. In this embodiment, the perforating gun assembly 124 is coupled to an adapter 148, which is coupled to a quick change 152. The quick change 152 is coupled to the setting tool 120, which includes the bulkhead igniter 156. The setting tool 120 has a first end 160 and a second end 164. The second end 164 may be coupled to a running gear adapter 168, which is coupled to the plug 116.

Figure 9:
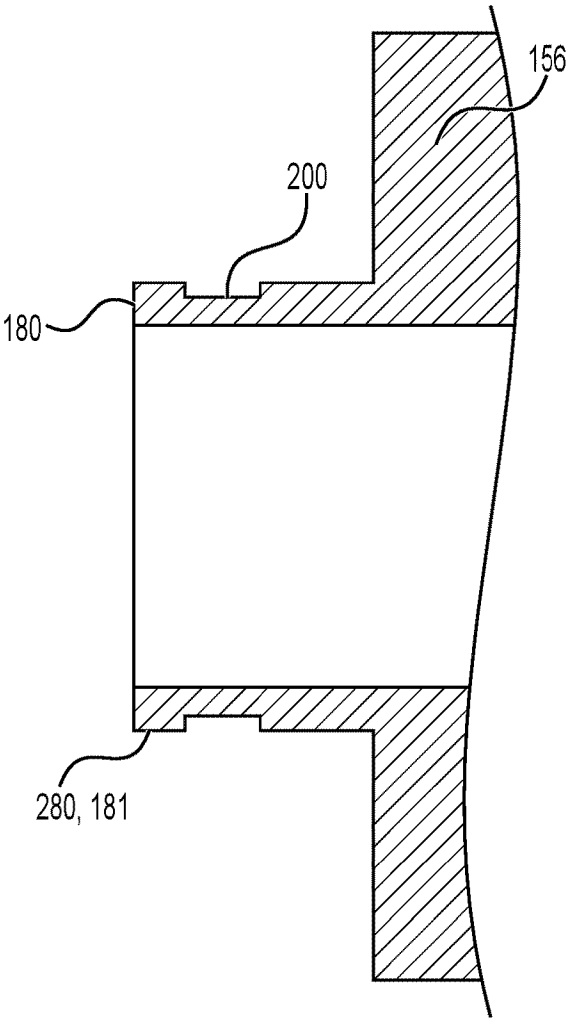
FIG. 9 is a schematic, cross section of a portion of a bulkhead igniter configured to mate with the snap-on insulator of FIG. 8 according to an illustrative embodiment.

Referring now primarily to FIGS. 3-7 and initially to FIG. 3, an illustrative embodiment of a bulkhead igniter assembly 176 and the snap-on insulator 172 are presented. As seen clearly in FIG. 3, the pressure bulkhead igniter 156 has a first end 180 and a second end 184. Just upstream of the bulkhead igniter 156 is an adjacent downhole component 188, which has a first end (not explicitly shown) and a second end 192. The second end 192 of the adjacent downhole component 188 is proximate to the first end 180 of the pressure bulkhead igniter 156. The bulkhead igniter 156 is disposed within a cavity 177 of a pressure block 157. The pressure block 157 is partially disposed within a cavity 159 of the setting tool 120 which is formed on the first end 160 of the setting tool 120. The pressure block 157 has a first end 161 and a second end 163. The first end 161 of the pressure block 157, when in an assembled position (shown in FIG. 3), abuts the second end 192 of the adjacent downhole component 188. The first end 180 of the bulkhead igniter 156 is formed with at least one ridge 196 (FIG. 4) or groove 200 (FIG. 9). In some embodiments, the bulkhead igniter 157 is sealed within the pressure block 157, at least partially, by the o-rings 175.

In some embodiments the pressure block 157 is attached to the setting tool 120 and the second end 192 of the adjacent downhole component 188 is attached to the first end 160 of the setting tool 120. In some embodiments, the second end 192 of the adjacent downhole component 188 is also attached to the first end 161 of the pressure block 157. In some embodiments, the second end 192 of the adjacent downhole component 188 is attached to the first end 161 of the pressure block 157, and the pressure block 157 is attached to the first end 160 of the setting tool 120. In some embodiments, the pressure block 157 is omitted and the igniter 156 is incorporated directly into the setting tool 120.

All connections herein referenced may be made by connection methods well known in the art such as threaded connections and quick connect connections.

The adjacent downhole component 188 is electrically coupled to the bulkhead igniter 156 by a conductive spring 165 and a conductive pin 167. At the time of assembly of the adjacent downhole component 188 to the setting tool 120, the spring 165 is extended and the pin 167 is inserted into and secured within a pin cavity 169 located on the first end 180 of the bulkhead igniter 156. The spring 165 and the pin 167, both being made of conductive material, provide a way of sending electrical current from the adjacent downhole component 188 to the bulkhead igniter 156. The electrical circuit through the bulkhead igniter 156 is completed by a grounding member 171, which extends from the sides of the bulkhead igniter 156 proximate to the second end 184 of the bulkhead igniter 156, but could be elsewhere. The grounding member 171 is made from a material capable of conducting electricity and contacts the pressure block 157 to provide an electrical pathway from the bulkhead igniter 156 to the pressure block 157.

By this arrangement, when a user desires to activate the bulkhead igniter 156, electrical current may be sent downhole and through the adjacent downhole component 188 to the bulkhead igniter 156 to activate the ignition components within the bulkhead igniter 156, for example by using wire line 132. However, in order to complete the electrical circuit, the bulkhead igniter must be grounded. Grounding is achieved through the grounding member 171 which completes a ground circuit from the bulkhead igniter 156 to the pressure block 157. The grounding member 171, may be any component capable of conducting electricity. In some embodiments, the grounding member 171 is a conductive spring, wire, or block. The grounding circuit is further completed by the pressure block 157 being in contact with the setting tool 120 and the adjacent downhole component 188, all of which are made from metallic conductors.

In order to prevent a short circuit and to achieve the desired electrical pathway, the electrically conductive parts of the bulkhead igniter 156 must not electrically contact the pressure block 157 other than at the grounding member 171. Therefore, a contact surface 173 of the bulkhead igniter 156, where the bulkhead igniter 156 contacts the pressure block 157, is coated with an electrical insulating material to prevent a short circuit at the contact surface 173. Grounding contact between the bulkhead igniter 156 and the pressure block 157 is further prevented by the snap-on insulator 172. The snap-on insulator 172 electrically insulates the bulkhead igniter 156 from the pressure block 157 proximate to the first end 180 of the bulkhead igniter 156.

Figure 5:
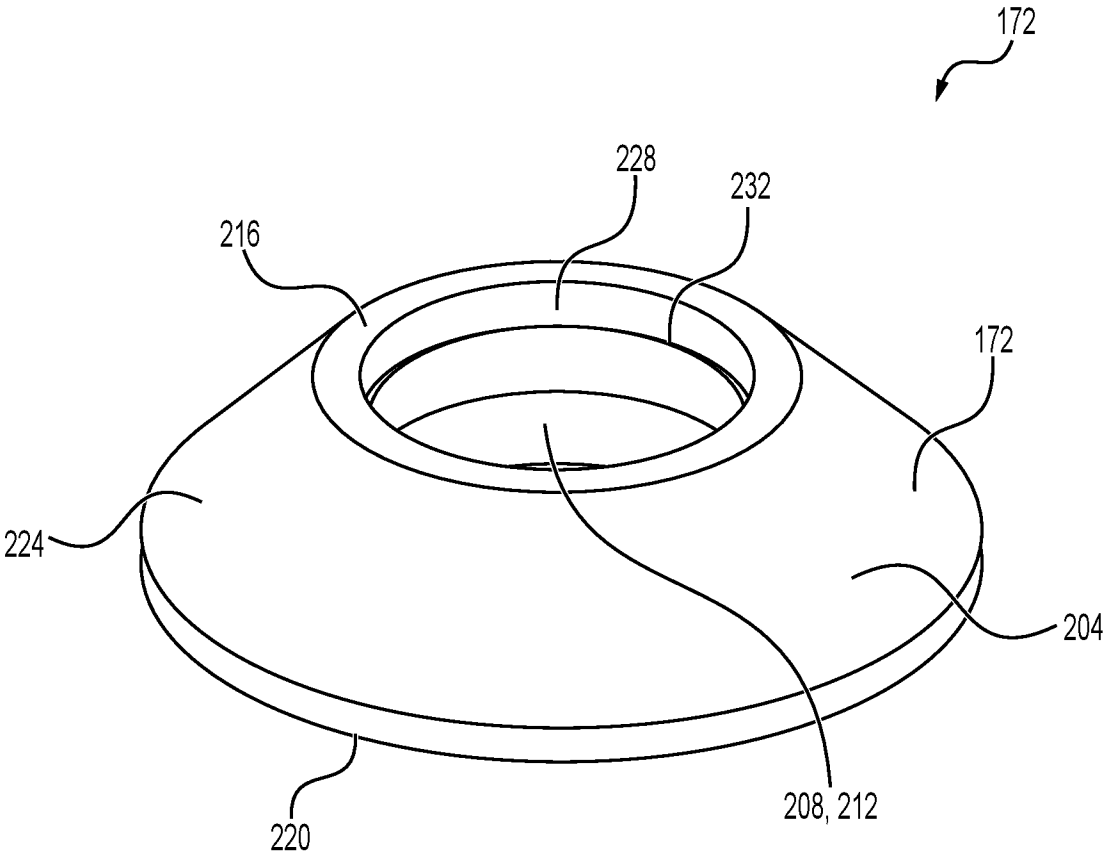
FIG. 5 is a schematic perspective view of a snap-on insulator according to an illustrative embodiment.

The snap-on insulator 172, as shown clearly in FIG. 5, is formed with an annular body 204 having a tubular channel 208 through a center portion 212. The snap-on insulator 172 has a first end 216 and a second end 220. The first end 216 interfaces at least partially with the pressure block 157. The second end 220 has a surface 221 that interfaces with a surface 222 (FIG. 6) proximate the first end 180 of the bulkhead igniter 156. The surfaces 221, 222 are at the same angle, which in this embodiment is 90 degrees to the tubular channel 208. In some embodiments, surfaces 221, 222 may be angled, e.g., with an angle between 30 and 90 degrees to the tubular channel 208.

The annular body 204 may have=an angled surface 224 between the first end 216 and the second end 220 relative to the tubular channel 208. The angled surface 224 presents an angled surface toward the adjacent downhole component 188 and faces the adjacent downhole component 188 when the assembled. In some embodiments the angled surface 224 forms an angle 226 (FIG. 7) between 30 and 60 degrees and in one embodiment is 45 degrees (see FIG. 8)

An interior 228 of the tubular channel 208 is formed with a groove 232 (FIG. 4) or ridge 236 (see e.g. FIG. 8) that is sized and configured to be a complimentary member to the ridge 196 (FIGS. 4 and 6) or groove 200 (FIG. 9) on the first end 180 of the bulkhead igniter 156, whereby a snap connection may be formed when in an assembled position. The snap-on insulator 172 is formed from a material that will not conduct electricity and that allows for enough flexibility for a ridge-and-groove coupling to occur when moving to the assembled position, and a material that is sufficient to protect anodization on the first end 180 of the bulkhead igniter 156 before ignition or use. The snap-on insulator 172 is made from a non-conductive material that is able to withstand downhole temperatures and pressures. The snap-on insulator 172 prevents an electrical connection between the pressure block 157 and the bulkhead igniter 156. In some embodiments the snap-on insulator 172 is made from a material that has a melting point greater than 250 degrees Fahrenheit. In some embodiments the snap-on insulator 172 is made from a material that has a melting point greater than 450 degrees Fahrenheit. In some embodiments, the snap-on insulator 172 is made from a polymer or plastic. In one embodiment, the snap-on insulator 172 is formed from NYLON, TEFLON, or DELRIN material.

Figure 6:
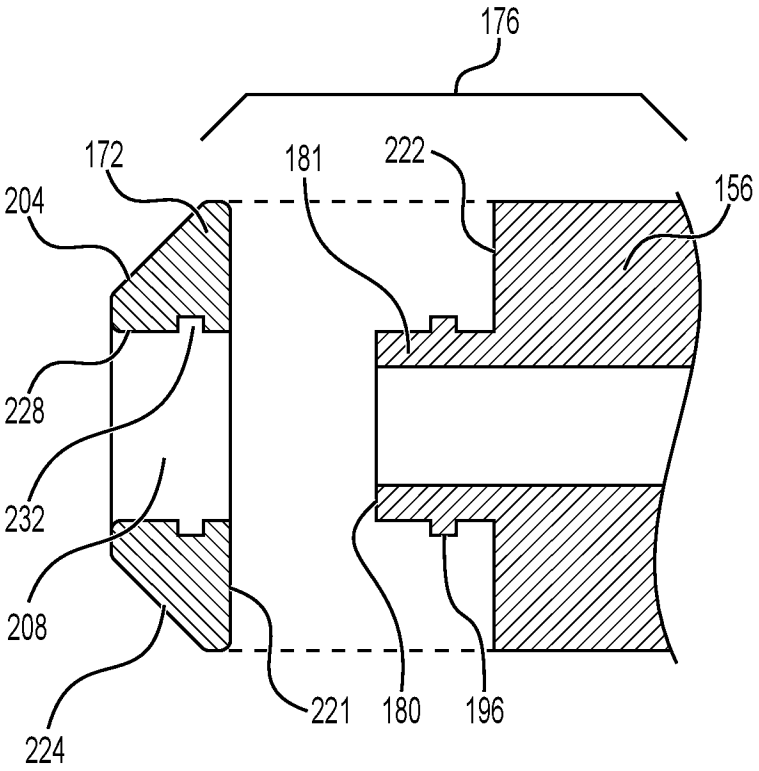
FIG. 6 is a schematic, exploded view in cross section of an illustrative embodiment of a snap-on insulator and a portion of a bulkhead igniter.

Referring now primarily to FIG. 6, an illustrative embodiment of the bulkhead igniter assembly 176 is presented. The snap-on insulator 172 has a groove 232 formed on the interior 228 of the tubular channel 208 that is sized and configured to mate with the ridge 196 formed on the first end 180 of the bulkhead igniter 156. In the embodiment of FIG. 6, the bulkhead igniter 156 has an annular protrusion 181 on the first end 180 of the bulkhead igniter 156. The ridge 196 is formed on the annular protrusion 181 of the bulkhead igniter 156. The tubular channel 208 is configured to be complementary to and to slide onto the annular protrusion 181 of the bulkhead igniter 156 so that the groove 232 and ridge 196 mate.

Figure 7:
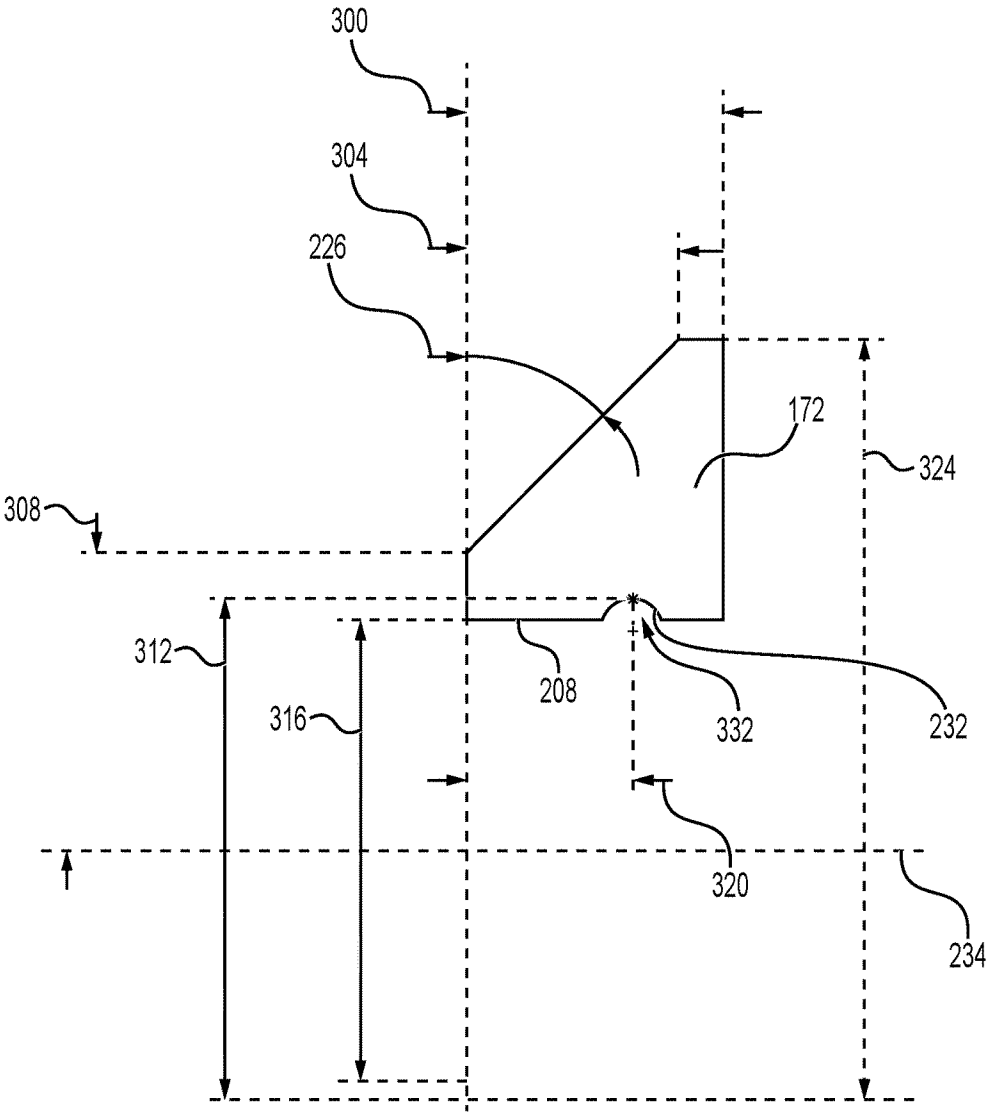
FIG. 7 is a schematic, cross section of a portion of a snap-on insulator according to an illustrative embodiment.

FIG. 7 presents one illustrative embodiment of a portion of the snap-on insulator 172 of FIG. 6 with illustrative dimensions presented here. Only one half is shown, but a mirrored image about center line 234 is to be understood. In some embodiments, a dimension 300 is in the range of 0.125-0.75 inches. In one embodiment, the dimension 300 is 0.125 inches. In some embodiments, a dimension 304 is in the range of 0.075-0.125 inches. In one embodiment, dimension the 304 is 0.10 inches. In some embodiments, a dimension 308 is in the range of 0.125-0.75 inches. In one embodiment, the dimension 308 is 0.285 inches. In some embodiments, a dimension 312 is in the range of 0.125-0.75 inches. In one embodiment, the dimension 312 is 0.24 inches. In some embodiments, a dimension 316 is in the range of 0.125-0.75 inches. In one embodiment, the dimension 316 is 0.22 inches. In some embodiments, a dimension 320 is in the range of 0.02-0.1 inches. In one embodiment, the dimension 320 is 0.08 inches. In some embodiments, a dimension 324 is in the range of 0.125-0.75 inches. In one embodiment, the dimension 324 is 0.49 inches. In some embodiments a radius 332 is 0.03 inches. In some embodiments, the radius 332 is in the range of 0.01-0.05 inches. In some embodiments, the angle 226 is in the range of 30-60 degrees relative to a reference line orthogonal to the center line 324 and aligned with dimension 300. In some embodiments, the angle 226 is 45 degrees relative to the reference line. Those skilled in the art will appreciate that other dimensions may be used.

Figure 8:
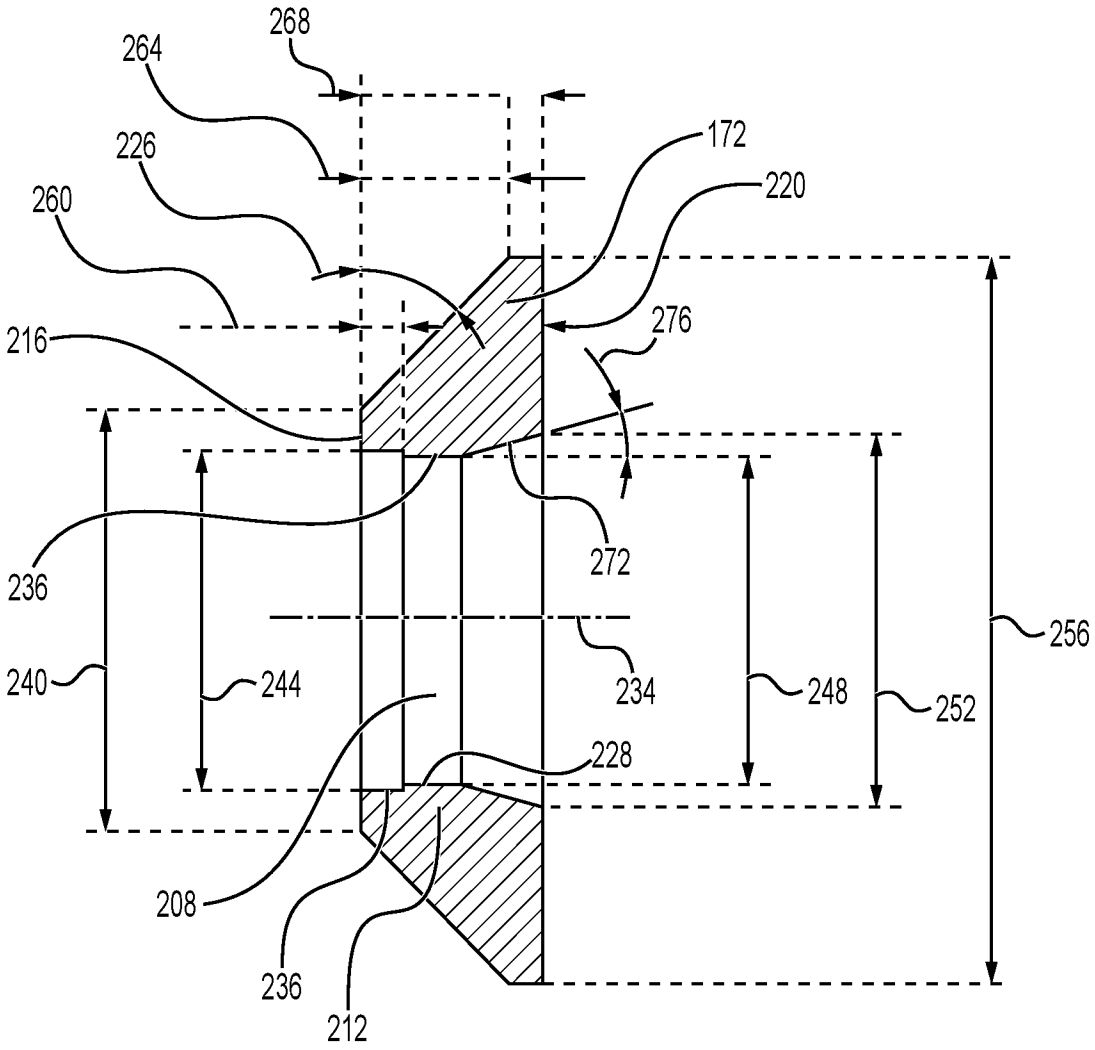
FIG. 8 is a schematic, cross section of a snap-on insulator according to an illustrative embodiment.

Referring now primarily to FIG. 8, another embodiment of the snap-on insulator 172 is presented. The embodiment has an elongated ridge 236 formed on the interior 228 of the tubular channel 208 that mates with the matching elongated groove 200 (FIG. 9). Illustrative dimensions for the snap-on insulator 172 of FIG. 8 are as follows: dimension 240 is in the range of 0.2 to 0.4 inches and in one embodiment is 0.285 inches; dimension 244 is in the range of 0.18 to 0.3 inches and in one embodiment is 0.230 inches; dimension 248 is in the range of 0.18 to 0.3 inches and in one embodiment is 0.220 inches; dimension 252 is in the range of 0.2 to 0.4 inches and in one embodiment is 0.25 inches; dimension 256 is in the range of 0.35 to 0.7 inches and in one embodiment is 0.49 inches; dimension 260 is in the range of 0.02 to 0.05 and in one embodiment is 0.03 inches; dimension 264 is in the range of 0.08 to 0.2 and in one embodiment is 0.0103 inches; and dimension 268 is in the range of 0.08 to 0.175 and in one embodiment is 0.125 inches. Those skilled in the art will appreciate that other dimensions may be used. This illustrative embodiment of the snap-on insulator 172 includes a chamfered edge 272 formed proximate the second end 220 and having an angle 276 in the range of 5 to 20 degrees and in one embodiment is 15 degrees. The chamfered edge 272 makes attachment of the snap-on insulator 172 easier going onto a leading barrel 280 (FIG. 9) or the annular protrusion 181 (FIG. 6) on the first end 180 of the bulkhead igniter 156.

Figure 10:
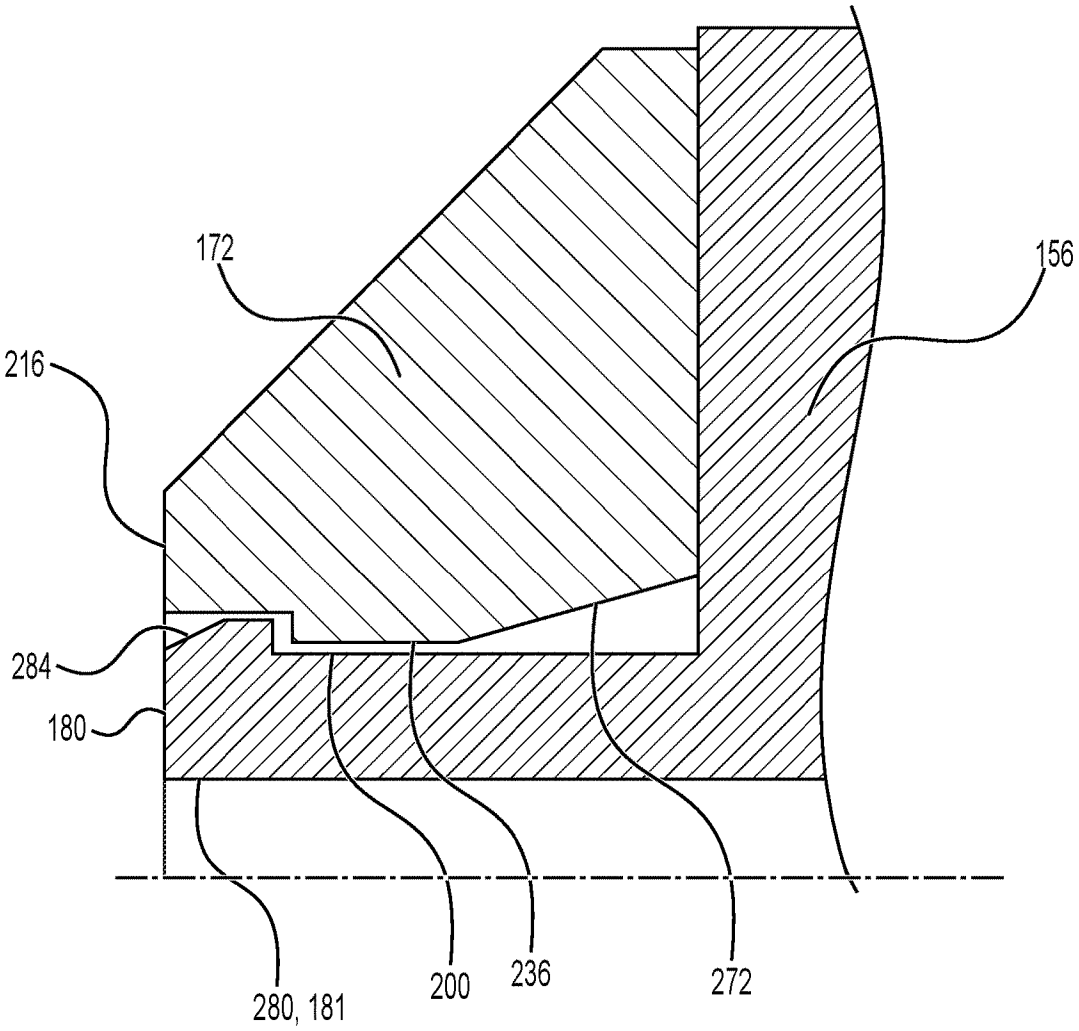
FIG. 10 is a schematic, cross section of a snap-on insulator according to an illustrative embodiment.

Referring now primarily to FIG. 10, another illustrative embodiment of a snap-on insulator 172 is presented. As in FIG. 7, only a half portion of the snap-on insulator 172 is shown. In this embodiment, the snap-on insulator 172 includes a chamfered edge 272, and the first end 180 of the bulkhead igniter 156 is formed with a chamfered edge 284 on the barrel 280 or annular protrusion 181. Other aspects are analogous to the snap-on insulator 172 of FIG. 8.

It should be appreciated that in the above described embodiments of the snap-on insulator 172 that snap-on insulator 172 is intended to be snapped or pressed on the first end of the bulkhead igniter 156 to facilitate installation of the snap-on insulator 172 onto the bulkhead igniter 156. The grooves 232 or ridges 236 of the snap-on insulator 172 are intended to compliment and mate with the grooves 200 or ridges 196 of the bulkhead igniter 156, so that the snap-on insulator 172 can be pressed onto the bulkhead igniter 156 and the interaction of the grooves 232 or ridges 236 with the grooves 200 or ridges 196 hold the snap-on insulator 172 in place on the bulkhead igniter 156 without the need for additional attachment methods such as threads, screws, bolts, or glues. In this manner the snap-on insulator 172 is installed onto the bulkhead igniter 156 by pressing the snap-on insulator 172 onto the bulkhead igniter 156 to engage the ridge 236 or groove 232 of the snap-on insulator 172 with the ridge 196 or groove 200 of the first end 180 of the bulkhead igniter 156. It should be appreciated that different shapes and configurations of the grooves 232, ridges 236, grooves 200, and ridges 196 may be used to achieve this desired engagement between the snap-on insulator 172 and the bulkhead igniter 156, for example, the illustrative embodiment of FIG. 4 uses rectangular shaped groove 232 in combination with rectangular shaped ridge 196; the illustrative embodiment of FIG. 7 uses a curved groove 232 and a corresponding curved ridge 196; and the illustrative embodiments of FIGS. 8, 9, and 10 use other groove/ridge shapes.

While shown applied to the first end of the bulkhead igniter, it should be understood that the snap-op insulator may be used on the second end in other applications.

In some embodiments, the snap-on insulator 172 is used may be used on igniters that are not bulkhead igniters, such as igniter 156. In these embodiments, the use of the snap-on insulator 172 in analogous as to the herein provided examples of use of the snap-on insulator 172 for bulkhead igniter 156.

Many examples are possible. More examples follow.

Example 1. A bulkhead igniter assembly comprising:

a pressure bulkhead igniter having a first end and a second end;

a downhole component having a first end and a second end and disposed adjacent to the first end of the pressure bulkhead igniter;

wherein the first end of the bulkhead igniter when in an assembled positions abuts the second end of the adjacent downhole component;

wherein the first end of the bulkhead igniter is formed with at least one ridge or groove;

a snap-on insulator, wherein the snap-on insulator comprises:

an annular body having a tubular channel through a center portion, wherein the snap-on insulator has a first end and a second end, wherein the annular body has an angled surface between the first end and second end of the snap-on insulator relative to the tubular channel, wherein an interior of the tubular channel is formed with a ridge or a groove that is sized and configured to be a complimentary member to the ridge or groove on the first end of the bulkhead igniter, whereby a snap connection may be formed when in an assembled position, and wherein the snap-on insulator is formed from a material that allows for enough flexibility for a ridge-and-groove coupling to occur when moving to the assembled position and a material sufficiently strong to protect anodization on the first end of the bulkhead igniter before ignition and a material that will not conduct electricity.

Example 2. The bulkhead igniter assembly of Example 1, wherein snap-on insulator is formed from NYLON.

Example 3. The bulkhead igniter assembly of Example 1 or 2, wherein the angled surface is a 45-degree angle from the tubular channel.

Example 4. The bulkhead igniter assembly of Example 1, 2, or 3, wherein the tubular channel proximate the second end has a chamfered edge.

Example 5. The bulkhead igniter assembly of Example 1, wherein the first end of the bulkhead igniter is formed with at least one groove and the tubular channel is formed with at least one ridge complementary to the at least one groove.

Example 6. The bulkhead igniter assembly of Example 1, wherein the first end of the bulkhead igniter is formed with at least one ridge and the tubular channel is formed with at least one groove complementary to the at least one groove.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A bulkhead igniter assembly comprising:

a bulkhead igniter having a first end and a second end, wherein the first end of the bulkhead igniter is formed with at least one ridge or groove on an annular protrusion;

a pressure block having a first end and a second end, wherein the bulkhead igniter is disposed within a cavity of the pressure block;

a setting tool having a first end and a second end, wherein the pressure block is at least partially disposed within a cavity of the setting tool located proximate to the first end of the setting tool; and a snap-on insulator, wherein the snap-on insulator comprises:

an annular body having a tubular channel through a center portion, wherein, the snap-on insulator has a first end and a second end, wherein, an interior of the tubular channel is formed with a ridge or a groove that is sized and configured to be a complimentary member to the ridge or groove on the first end of the bulkhead igniter, whereby the snap-on insulator is held in place on the bulkhead igniter by interaction of the ridge or groove of the snap-on insulator with the ridge or groove on the first end of the bulkhead igniter, wherein, the snap-on insulator is formed from a material that allows for enough flexibility for a ridge-and-groove coupling to occur so that the snap-on insulator may be installed onto the bulkhead igniter by pressing the snap-on insulator onto the bulkhead igniter to engage the ridge or groove of the snap-on insulator with the ridge or groove of the first end of the bulkhead igniter; and wherein, the snap-on insulator is formed from a material that will not conduct electricity.

2. The bulkhead igniter assembly of claim 1, further comprising a downhole component having a first end and a second end, wherein the second end of the downhole component is attached to the first end of the setting tool or to the first end of the pressure block and the second end of the downhole component is disposed proximate to the first end of the bulkhead igniter.

3. The bulkhead igniter assembly of claim 2, wherein the annular body has an angled surface between the first end and second end of the snap-on insulator relative to the tubular channel and when assembled the angled surface faces towards the downhole component.

4. The bulkhead igniter of claim 3, wherein the angled surface is a 45-degree angle from the tubular channel.

5. The bulkhead igniter assembly of claim 2, wherein, the annular body has an angled surface between the first end and second end of the snap-on insulator relative to the tubular channel and when assembled the angled surface faces towards the downhole component;

wherein, the angled surface is a 45-degree angle from the tubular channel;

wherein, the snap-on insulator prevents an electrical connection between the bulkhead igniter and the pressure block;

wherein, the snap-on insulator is made from a material that is non-conductive and has a melting temperature greater than 250 degrees Fahrenheit;

wherein, the tubular channel has a chamfered edge proximate to the second end of the snap-on insulator.

6. The bulkhead igniter assembly of claim 1, wherein the snap-on insulator prevents an electrical connection between the bulkhead igniter and the pressure block.

7. The bulkhead igniter assembly of claim 1, wherein the snap-on insulator is made from a material that is non-conductive and has a melting temperature greater than 250 degrees Fahrenheit.

8. The bulkhead igniter assembly of claim 7, wherein the snap-on insulator is made from NYLON, TEFLON, or DELRIN material.

9. The bulkhead igniter of claim 8, wherein the snap-on insulator is made from NYLON.

10. The bulkhead igniter of claim 8, wherein the snap-on insulator is made from DELRIN.

11. The bulkhead igniter assembly of claim 1, wherein the interior of the tubular channel of the snap-on insulator is formed with a ridge and the bulkhead igniter is formed with a groove.

12. The bulkhead igniter assembly of claim 1, wherein the interior of the tubular channel of the snap-on insulator is formed with a groove and the bulkhead igniter is formed with a ridge.

13. The bulkhead igniter assembly of claim 1, wherein the tubular channel has a chamfered edge proximate to the second end of the snap-on insulator.

14. A bulkhead igniter assembly comprising:

a bulkhead igniter having a first end and a second end, wherein the first end of the bulkhead igniter is formed with at least one ridge or groove;

a pressure block having a first end and a second end, wherein the bulkhead igniter is disposed within a cavity of the pressure block; and a snap-on insulator, attached to the first end of the bulkhead igniter, wherein, the snap-on insulator comprises:

an annular body having a tubular channel through a center portion, wherein, the snap-on insulator has a first end and a second end, wherein, an interior of the tubular channel is formed with a ridge or a groove that is sized and configured to mate in a complementary manner to the ridge or groove on the first end of the bulkhead igniter, whereby the snap-on insulator is held in place on the bulkhead igniter by interaction of the ridge or groove of the snap-on insulator with the ridge or groove on the first end of the bulkhead igniter; and wherein, the snap-on insulator is formed from a material that allows for enough flexibility for a ridge-and-groove coupling to occur so that the snap-on insulator may be installed onto the bulkhead igniter by pressing the snap-on insulator onto the bulkhead igniter to engage the ridge or groove of the snap-on insulator with the ridge or groove on the first end of the bulkhead igniter, and wherein, the snap-on insulator is formed from a material that will not conduct electricity.

15. The bulkhead igniter assembly of claim 14, wherein the first end of the bulkhead igniter has an annular protrusion and the at least one ridge or groove formed on the bulkhead igniter is formed on the annular protrusion of the bulkhead igniter.

16. The bulkhead igniter of claim 15, wherein the tubular channel of the snap-on insulator is configured to be complementary to and to slide onto the annular protrusion of the bulkhead igniter.

17. The bulkhead igniter assembly of claim 14, wherein the snap-on insulator is made from NYLON, TEFLON, or DELRIN material.

18. The bulkhead igniter assembly of claim 14, wherein the interior of the tubular channel of the snap-on insulator is formed with a ridge and the bulkhead igniter is formed with a groove.

* * * * *